US008210859B2

(12) United States Patent
Tiberghien et al.

(10) Patent No.: US 8,210,859 B2
(45) Date of Patent: Jul. 3, 2012

(54) FEMALE CONNECTOR ELEMENT AND CONNECTOR INCLUDING SAME

(75) Inventors: Alain-Christophe Tiberghien, Sevrier (FR); Philippe Guin, Annecy (FR); Jean-Claude Corsetti, Faverges (FR)

(73) Assignee: Staubli Faverges, Faverges (FR)

( * ) Notice: Subject to any disclaimer, the term of this patent is extended or adjusted under 35 U.S.C. 154(b) by 97 days.

(21) Appl. No.: 12/921,674

(22) PCT Filed: Mar. 11, 2009

(86) PCT No.: PCT/FR2009/050398

§ 371 (c)(1), (2), (4) Date: Oct. 21, 2010

(87) PCT Pub. No.: WO2009/122055

PCT Pub. Date: Oct. 8, 2009

(65) Prior Publication Data

US 2011/0263144 A1 Oct. 27, 2011

(30) Foreign Application Priority Data

Mar. 12, 2008 (FR) ..... 08 51613

(51) Int. Cl.
*H01R 13/44* (2006.01)

(52) U.S. Cl. ..... 439/135

(58) Field of Classification Search ..... 439/135, 439/134, 133, 346, 304
See application file for complete search history.

(56) References Cited

U.S. PATENT DOCUMENTS

| | | | | |
|---|---|---|---|---|
| 4,610,564 | A | 9/1986 | Vantouroux | |
| 5,718,602 | A | 2/1998 | Savoca | |
| 6,435,903 | B1 | 8/2002 | Nelson | |
| 6,524,057 | B1 | 2/2003 | Park | |
| 6,802,730 | B2 * | 10/2004 | Chang | 439/236 |
| 6,884,103 | B1 * | 4/2005 | Kovacs | 439/336 |
| 7,029,303 | B2 * | 4/2006 | Bordeau et al. | 439/286 |
| 7,044,783 | B2 * | 5/2006 | Fan | 439/567 |
| 7,121,867 | B2 * | 10/2006 | Annecke | 439/352 |
| 7,726,999 | B2 * | 6/2010 | Vanzo | 439/333 |

FOREIGN PATENT DOCUMENTS

| | | |
|---|---|---|
| FR | 1517580 | 3/1968 |
| FR | 2828665 A | 2/2003 |
| FR | 2881279 A | 7/2006 |
| GB | 1137294 | 12/1968 |
| GB | 2253601 A | 8/1992 |
| GB | 2373380 A | 9/2002 |

* cited by examiner

*Primary Examiner* — Tulsidas C Patel
*Assistant Examiner* — Phuongchi Nguyen
(74) *Attorney, Agent, or Firm* — Dowell & Dowell, PC

(57) ABSTRACT

The invention relates to a female element (2) that comprises at least one terminal conduction component and a receptacle (20) for receiving a body (10) of a male element (1) along a longitudinal direction ($X_2$-$X'_2$). The female element (2) has a proximal portion (210) fitted to receive an electric power cable ($C_2$). The receptacle (20) includes a guiding chamber (205) for said body (10) in translation along said longitudinal direction ($X_2$-$X'_2$), and at least one guiding edge for guiding said body (10) revolving around an axis ($X_1$-$X'_1$) of said body (10), the one or each guiding edge being disposed, along said longitudinal direction ($X_2$-$X'_2$), between said guiding chamber (205) and the one or each terminal component. The guiding chamber (205) has a cylindrical form with a circular base circumscribed on a triangular base of the body (10) of the male element (1).

13 Claims, 4 Drawing Sheets

FEMALE CONNECTOR ELEMENT AND CONNECTOR INCLUDING SAME

The present invention relates to a female connector element, which is intended to engage with a complementary male connector element in order to interconnect electrical power cables. Moreover, the present invention relates to a connector including such a male element and such a female element in order to interconnect electrical power cables.

In the field of high-power electrical energy transfer, in particular between a ship and a terminal such as a port facility, a connection device and method, such as the one described in WO 2007/107673, are generally used to interconnect electrical power cables. Such a connection device employs a connector, the male and female elements of which are designed in accordance with the electrical power to be transferred.

The connection method according to WO 2007/107673 includes steps consisting in tying a traction rope from a ship to a connector element mounted on an electrical power cable originating from a port terminal, pulling this electrical power cable towards the ship and interconnecting the connector element, with which this electrical power cable is equipped, with a complementary connector element, with which an electrical power cable originating from the ship is equipped.

When these two connector elements, male and female, are coupled together, electrical energy can be transferred from the terminal to the ship, or vice versa.

As the electrical power is high, up to 30 megawatts (MW), such a connection device uses electrical power cables having large diameters, of around 100 mm, having a mass per unit length of 15 kg/m, in particular in the case of a three-phase electrical line. Consequently, the connection device employs connection means which are very heavy and awkward to handle.

Now, the operations of connecting and above all of disconnecting the electrical power line have to be carried out quickly. However, the weight and stiffness of the electrical power cables make these connecting operations difficult, and therefore slow to carry out. Specifically, the phase correspondence of the electrical power cables of the ship and of the terminal means that either a connector in which the relative angular orientation of these male and female elements is unimportant or an auxiliary device which indexes the phases at the end of the connection operations is used. In both cases, the connection system uses complicated equipment, which is therefore expensive, to interconnect the male and female elements with which the electrical power cables are respectively equipped.

Document U.S. Pat. No. 4,620,564 describes a female connector element which is intended to engage with a male element in order to interconnect electrical cables. The female element has a receptacle for the body of the male element 1. This receptacle includes a chamber 4 for guiding the body 3 translationally. This female connector does not guide the male element in rotation in the female element. The safety and reliability of transmission of a high-power electrical current through the connector of U.S. Pat. No. 4,620,564 are thus relatively low.

The invention aims, in particular, to remedy these drawbacks by providing a female connector element and a connector which make it easier to connect electrical power cables and which simplify in particular the relative guidance of the male and female elements.

To this end, the subject of the invention is a female connector element intended to engage with a complementary male connector element for the interconnection of electrical power cables, in particular between a ship and a terminal, the female element having at least one electrically conductive terminal component and a receptacle intended to receive a body of said male element and extending in a longitudinal direction, the female element having a proximal part designed to receive an electrical power cable in order to electrically power the or each terminal component, the receptacle including a chamber for guiding said body translationally in said longitudinal direction, and also at least one guide edge designed to guide said body in rotation about a longitudinal axis of said body, the or each guide edge being located, in said longitudinal direction, between said guide chamber and the or each terminal component. This female element is characterized in that the guide chamber is in the form of a cylinder having a circular base, said circular base being defined by a circle approximately circumscribed about a triangular base of said body of the male element, which is approximately in the form of a prism having an equilateral triangular base, and the or each guide edge extends in a plane parallel to the axis of said cylinder, intersecting said cylinder and spaced apart from the axis of said cylinder by a distance corresponding approximately to the apothem of said triangular base, the or each guide edge extending, furthermore, in a direction inclined with respect to the axis of said cylinder at an angle of between 30° and 80°, preferably between 50° and 70°.

According to further advantageous, but not obligatory, features of the invention, taken individually or in any technically feasible combination:

- the female element furthermore comprises at least one cylindrical roller, the or each roller being mounted such that it can rotate with respect to said receptacle, the inner generatrix of the or each roller being able to form the or each guide edge;
- the female element comprises three rollers defining three guide edges extending in three different planes parallel to the axis of said cylinder, the three planes forming, in section through a plane perpendicular to the axis of said cylinder, a triangle corresponding approximately to said triangular base;
- the female element furthermore comprises a case forming a housing for the or each terminal component;
- the female element furthermore comprises a tube extending inside the case, said tube being suitable for receiving a traction means such as a chain or a cable, and at least one terminal component has surfaces in the form of annular sectors for electrical contact with the or each terminal member; and
- the case has a distal opening, the distal end of the tube is equipped with a flange for closing off said distal opening, said tube being able to move translationally along the axis of said cylinder, and the female element has a member for returning said tube to the closed-off position.

In addition, the subject of the invention is a connector for the interconnection of electrical power cables, in particular between a ship and a terminal, including a male element and a female element, characterized in that said female element is as explained hereinabove, in that said male element has at least one electrically conductive terminal member and a body forming a housing for the or each terminal member, in that the male element has a proximal part designed to receive an electrical power cable in order to electrically power the or each terminal member, in that said body is approximately in the form of a prism having an equilateral triangular base, and in that the or each terminal member and the or each terminal component have respectively complementary forms.

According to further advantageous, but not obligatory, features of the invention, taken individually or in any technically feasible combination:

- the body of the male element has a distal face which is generally perpendicular to the axis of said prism, said face defining at least one rectilinear or convex distal edge with a face of said prism;
- the male element furthermore comprises a column extending inside the body and along the axis of the prism, the or each terminal member being mounted on said column, and at least one terminal member having at least one surface in the form of an annular sector for electrical contact with the or each terminal component of said female element;
- the body has a distal opening and the male element has means for closing off said distal opening, said closing-off means being able to move inside the body, and the male element has means for returning said closing-off means to the closed-off position;
- the distal end of the column is located in the central region of said distal opening and defines a generally annular opening, the closing-off means comprise a washer having the form of said annular distal opening, said washer being able to slide along the axis of the prism, and said return means include a helical spring working in compression in the direction of the axis;
- the distal face of the body has a smooth surface having a planar or convex form; and
- said column comprises a fastening member for attaching a traction means such as a chain or a cable.

The invention will be understood well and its advantages will also become apparent in the light of the following description, given by way of nonlimiting example and with reference to the appended drawings, in which:

FIG. 1 shows a connector C including a male element 1 and a female element 2, which are in the disconnected state, i.e. at the start of a connecting operation or at the end of a disconnecting operation.

The male element 1 has a proximal part 110 designed to take an electrical power cable $C_1$ linked to a port terminal. Similarly, the female element 2 has a proximal part 210 designed to take an electrical power cable $C_2$ linked to the electrical installation of a ship. The terms "proximal" and "distal" relate to the distance of a part in relation to the electrical power cable which has connected to it the respectively male or female element to which this part belongs. Thus, a proximal part is relatively close to the electrical cable $C_1$ or $C_2$, whereas a distal part is further away therefrom.

Figure 7:
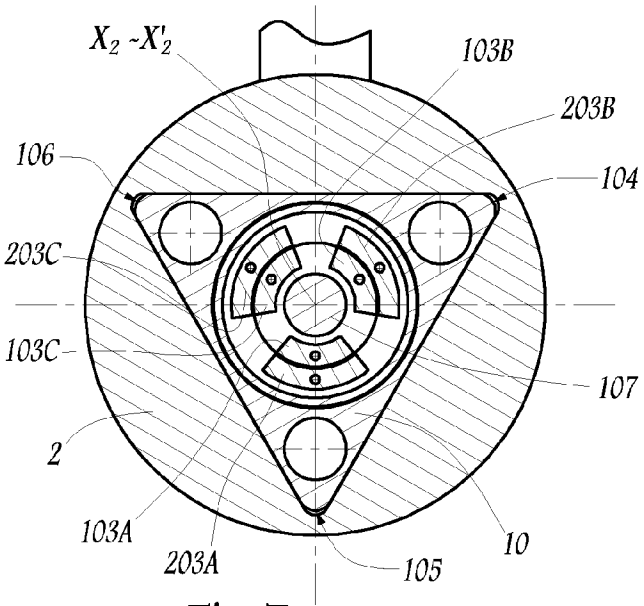
FIG. 7 is a view of the connector in FIG. 6, on a larger scale and in section on the line VIII-VIII in FIG. 6.
Figure 6:
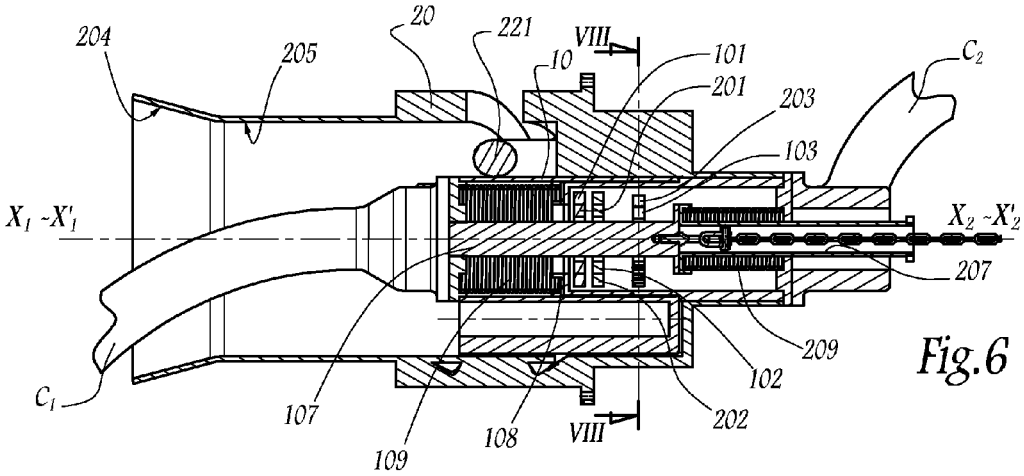

The male element 1 comprises a body 10 which extends generally along an axis $X_1$-$X'_1$ and the female element 2 comprises a receptacle 20 which extends generally along an axis $X_2$-$X'_2$. The axes $X_1$-$X'_1$ and $X_2$-$X'_2$ define respective longitudinal directions of the male element 1 and the female element 2. When the male element 1 and the female element 2 are in the connected state, as illustrated in FIGS. 6 and 7, the axis $X_1$-$X'_1$ coincides with the axis $X_2$-$X'_2$.

Figure 2:
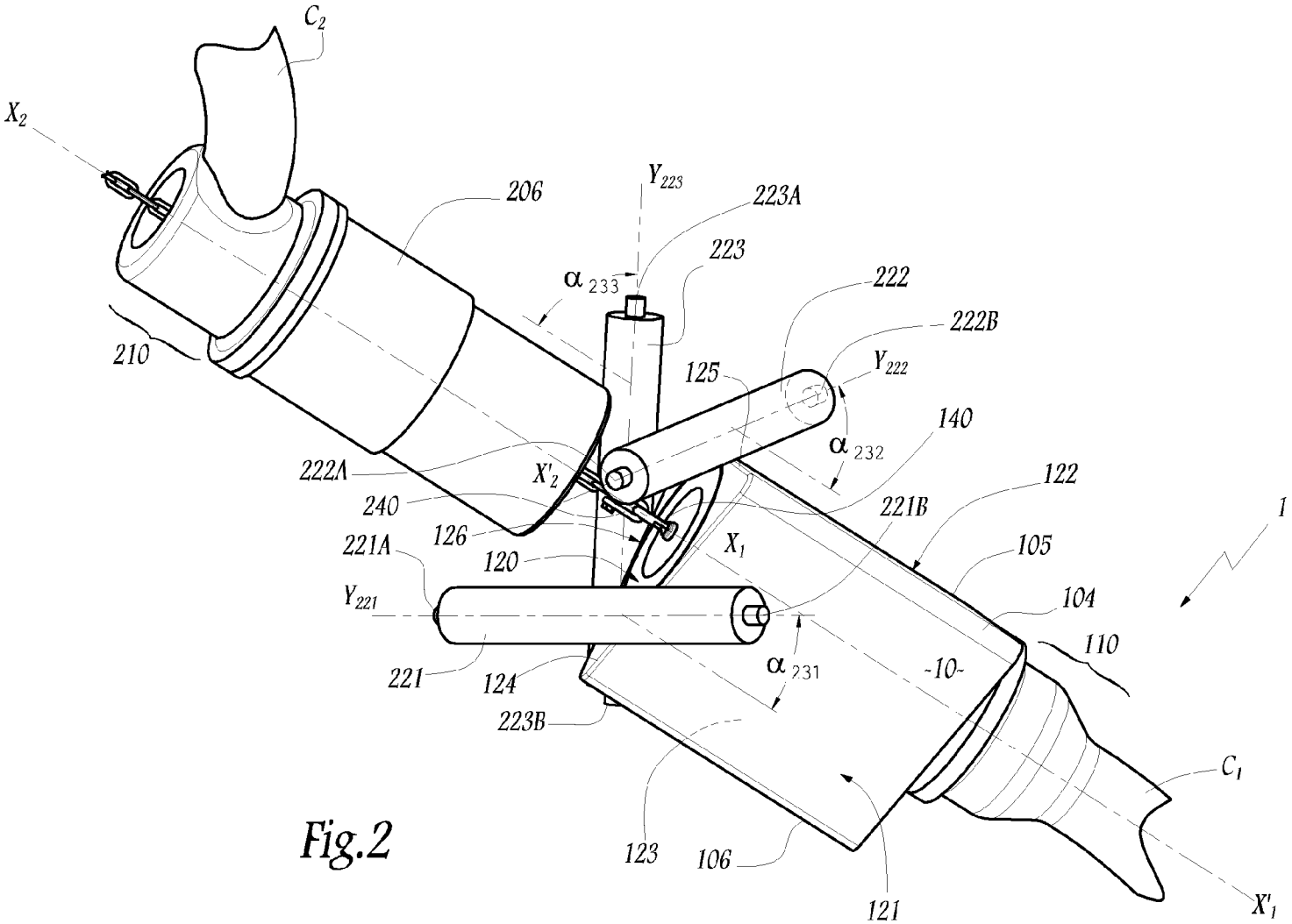
FIG. 2 is a perspective view on a larger scale of part of the connector in FIG. 1.
Figure 4:
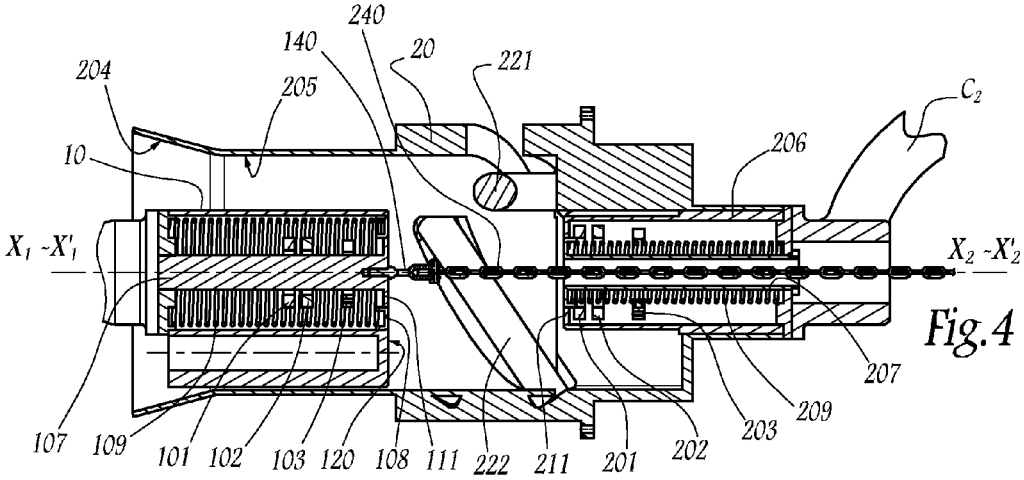
FIGS. 4, 5 and 6 are sections, on the plane Π in FIG. 1, of the connector in FIGS. 1 to 3, in the disconnected state, in the course of being connected, in the connected state, respectively.

During connecting operations, in order to bring the male element 1 and the female element 2 together, as shown in FIGS. 2 and 4, a traction chain 240 is coupled to a fastening ring 140 provided at the distal end of the body 10, and then an apparatus such as a winch pulls the male element 1 into the female element 2.

Figure 1:
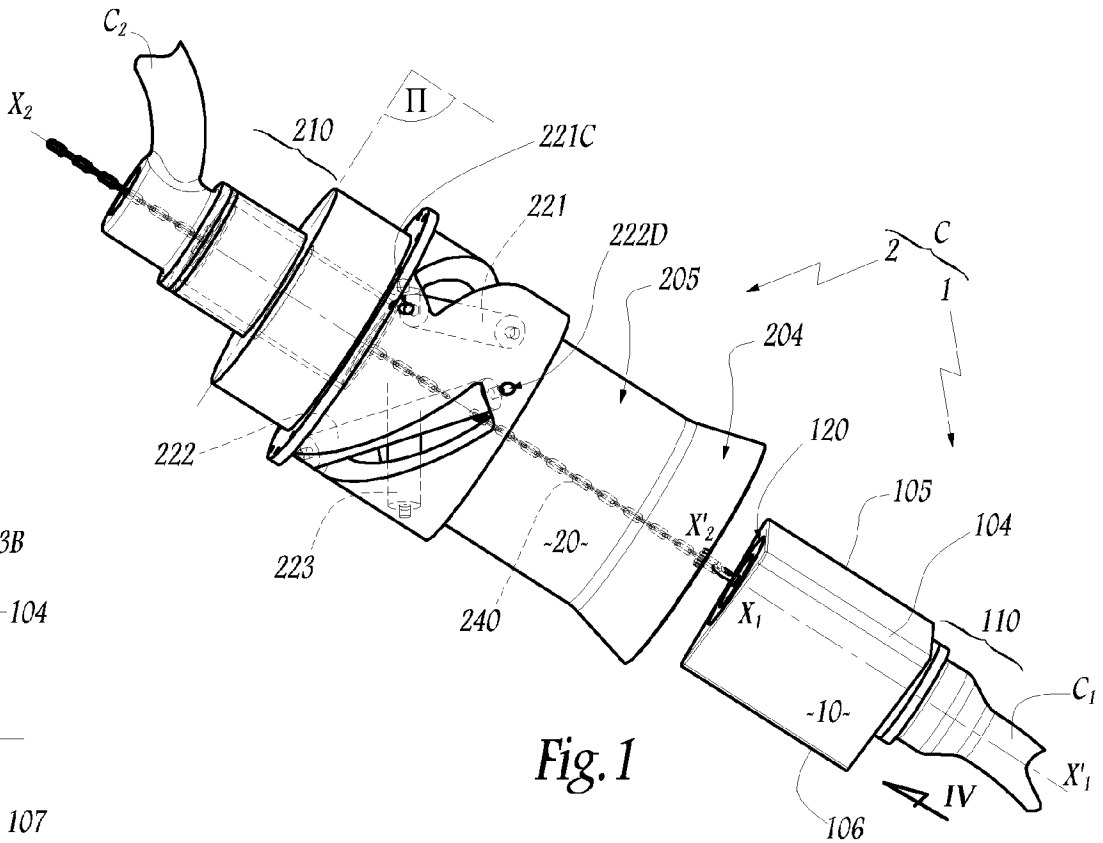
FIG. 1 is a perspective view of a connector in accordance with the invention, having a male element and a female element in accordance with the invention, and in the disconnected state.

As shown in FIGS. 1 and 2, the body 10 is approximately in the form of a prism of axis $X_1$-$X'_1$ having an equilateral triangular base. The term "base" designates a section of the body 10 through a plane perpendicular to the axis $X_1$-$X'_1$. The body 10 has a distal face 120, forming a base of the prism, and longitudinal faces 121, 122 and 123, which are parallel to the axis $X_1$-$X'_1$. In the embodiment illustrated in the figures, the body 10 has longitudinal edges 104, 105 and 106, corresponding to the generatrices of the prism, which are rounded or "blunt" so as to reduce the contact pressure, and therefore to facilitate guidance, of the body 10 in the receptacle 20. The longitudinal edges 104, 105 and 106 separate the longitudinal faces 121, 122 and 123 of the body 10. The latter share distal edges 124, 125 and 126 with the distal face 120.

As shown in FIGS. 1 and 3 to 6, the receptacle 20 includes a guide chamber 205 which is generally in the form of a cylinder of axis $X_2$-$X'_2$ having a circular base. In this case, the term "base" designates a section of the guide chamber through a plane perpendicular to the axis $X_2$-$X'_2$. While the male element 1 and the female elements 2 are being connected, the guide chamber 205 guides the body 10 translationally in its longitudinal direction formed in this case by the axis $X_2$-$X'_2$. As is shown more precisely in FIG. 3, the circular base of the guide chamber 205 is defined by a circle circumscribed about the triangular base of the prismatic body 10. In other words, the triangular base of the body 10 fits, with a functional clearance, into the circular base of the guide chamber 205 of the receptacle 20. The distal end of the receptacle 20 comprises a frustoconical part 204 which flares outwards and forms a primary guide zone for the body 10.

The receptacle 20 further includes three identical rollers 221, 222 and 223, which each have a cylindrical form. Each of the rollers 221, 222 and 223 is mounted such that it can rotate with respect to the receptacle 20 and about its respective axis $Y_{221}$, $Y_{222}$ or $Y_{223}$. For this purpose, as shown in FIGS. 2 and 3, the ends of the rollers 221, 222 and 223 are each equipped with journals 221A, 221B, 222A, 222B and 223A, 223B which are inserted into respective orifices 221C, 221D, 222C, 222D and 223C, 223D machined into the receptacle 20.

Figure 3:
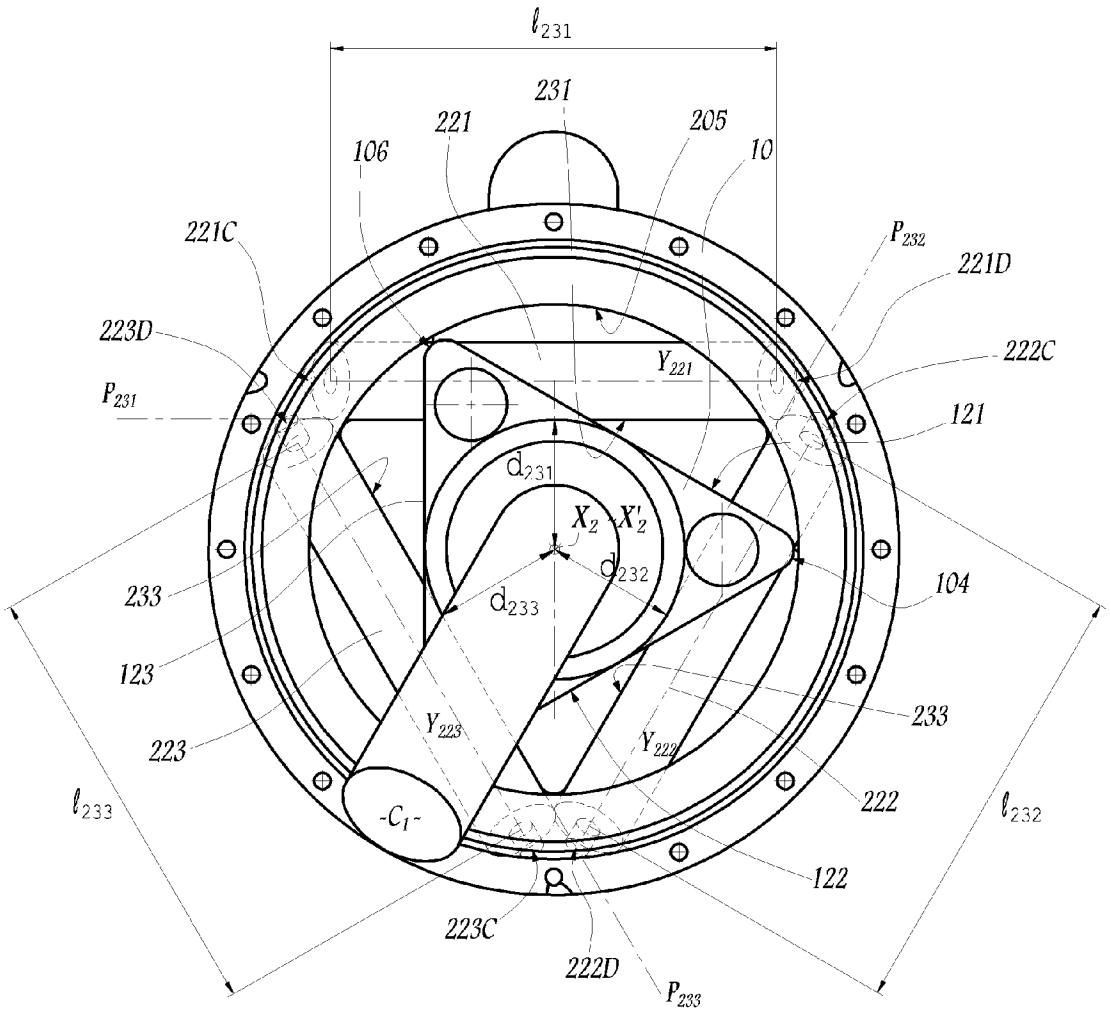
FIG. 3 is a front view on a larger scale of the connector in FIG. 1, on the line IV in FIG. 1.

As shown in FIG. 3, the generatrices of the rollers 221, 222 and 223 which are turned towards the axis $X_2$-$X'_2$ define respective edges 231, 232 and 233, called inner edges, since they are oriented towards the axis $X_2$-$X'_2$. The three inner edges 231, 232 and 233 extend respectively in three different planes $P_{231}$, $P_{232}$ and $P_{233}$ parallel to the axis $X_2$-$X'_2$. The planes $P_{231}$, $P_{232}$ and $P_{233}$ form, in section through a plane perpendicular to the axis $X_2$-$X'_2$, a triangle which corresponds approximately to the triangular base of the body 10.

In addition, each plane $P_{231}$, $P_{232}$ or $P_{233}$ is separated from the axis $X_2$-$X'_2$ by a respective distance $d_{231}$, $d_{232}$ or $d_{233}$ which corresponds approximately to the apothem of the triangular base of the body 10. The term "apothem" designates the distance separating the center of gravity of the equilateral triangle from one or the other of its sides, in orthogonal projection. The distances $d_{231}$, $d_{232}$ and $d_{233}$ are defined in projection in a plane perpendicular to the axis $X_2$-$X'_2$, such as the plane of FIG. 3.

Each inner edge 231, 232 or 233 extends in a direction inclined, with respect to the axis $X_2$-$X'_2$ of the guide chamber 205, at a respective angle $\alpha_{231}$, $\alpha_{232}$ and $\alpha_{233}$, shown in FIG. 2, which is around 60°. In practice, each angle $\alpha_{231}$, $\alpha_{232}$ or $\alpha_{233}$ can be between 30° and 80°, preferably between 50° and 70°. Such an inclination of the edges 231, 232 and 233 makes it possible to rotate the body 10 about the axis $X_1$-$X'_1$.

During its introduction into the receptacle 20, the body 10 is first guided by the frustoconical part 204, then by the guide chamber 205. The axes $X_1$-$X'_1$ and $X_2$-$X'_2$ coincide, except for a functional clearance. However, the body 10 is not necessarily oriented properly about its axis $X_1$-$X'_1$.

As illustrated in FIGS. 2 and 3, the edges 124, 125 and 126 come into contact with the rollers 221, 222 and 223. On account of the inclination of the rollers 221, 222 and 223, the body 10 is rotated under the effect of the force exerted on the body 10 by way of the traction chain 240. This rotation is combined with its translational movement along the axis $X_1$-$X'_1$ until the faces 121, 122 and 123 of the prism formed by the body 10 come into angular coincidence with the triangular section defined by the planes $P_{231}$, $P_{232}$ and $P_{233}$.

By engaging with the edges 124, 125 and 126, the rollers 221, 222 and 223 guide the body 10 in rotation about its axis $X_1$-$X'_1$. Each generatrix of each roller 221, 222 and 223 can form a guide edge of the body 10. Following this angular coincidence, the body 10 is guided only translationally, because the inner edges 231, 232 and 233 of the rollers are respectively in the planes $P_{231}$, $P_{232}$ and $P_{233}$ corresponding to the faces 121, 122 and 123 of the prism formed by the body 10.

The orthogonal projections $l_{231}$, $l_{232}$ and $l_{233}$ of the respective inner edges 231, 232 and 233 of the rollers 221, 222 and 223 on a plane perpendicular to the axis $X_2$-$X'_2$ are longer than those of the sides of the triangular base of the prism in order that the distal edges 124, 125 and 126 come into contact with a generatrix of the rollers 221, 222 and 223, whatever the initial orientation of the body 10.

As soon as they engage with the body 10, the rollers 221, 222 and 223 rotate about their respective axes, and this contributes to reducing friction and thus to ensuring the durability of the device.

In addition, as shown in FIGS. 4 to 7, the male element 1 comprises conductive terminal members 101, 102 and 103 linked to the electrical cable $C_1$. The body 10 forms a housing for the terminal members 101, 102 and 103. The terminal members 101, 102 and 103 are arranged in succession along the axis $X_1$-$X'_1$ and around a column 107 which extends inside and at the center of the body 10 and along the axis $X_1$-$X'_1$.

Similarly, the female element 2 comprises conductive terminal components 201, 202 and 203 linked to the electrical cable $C_2$. The terminal components 201, 202 and 203 are housed inside a cylindrical case 206 of axis $X_2$-$X'_2$. The terminal components 201, 202 and 203 are arranged in succession along the axis $X_2$-$X'_2$. Furthermore, the female element 2 comprises a tube 207 which extends inside the case 206 and in this case is coaxial with the axis $X_2$-$X'_2$. The tube 207 is designed to allow the traction chain 240, which can be coupled to the fastening ring 140 located at the distal end of the column 107, to pass through its hollow part.

The terminal members 101, 102 and 103 each have at least one surface for electrical contact with a respective complementary surface of the terminal components 201, 202 and 203. In this case, as shown in FIGS. 4 to 7, the terminal members 101, 102 and 103 have an annular form with a cylindrical outer radial surface, which is coaxial with the axis $X_1$-$X'_1$, for electrical contact. Similarly, the terminal components 201, 202 and 203 have an annular form with a cylindrical inner radial surface, which is coaxial with the axis $X_2$-$X'_2$.

The diameter of the outer surface of each terminal member 101, 102 or 103 corresponds approximately to the diameter of the inner radial surface of each terminal component 201, 202 or 203, and as a result electrical contact is produced at these inner and outer radial surfaces when the connector C is in the connected state, as shown in FIGS. 6 and 7.

In a known manner, electrical contact can be produced by means of conducting fins, the flexibility of which in the radial direction enables fitting with respect to the clearance.

The three terminal members 101, 102 and 103 of the male element 1 and the three terminal components 201, 202 and 203 of the female element 2 are intended to interconnect the electrical cables $C_1$ and $C_2$.

The terminal member 103 is intended for a three-phase electrical connection. As shown in FIG. 7, it is in fact made up of three annular sectors 103A, 103B and 103C, which each correspond to a phase of the three-phase cable $C_1$. Similarly, the terminal component 203 is in fact made up of three annular sectors 203A, 203B and 203C, which each correspond to one phase of the three-phase cable $C_2$.

When the body 10 is oriented correctly about the axis $X_2$-$X'_2$, the corresponding surfaces of the terminal member 103 and of the terminal component 203 are in contact. The terminal members 101, 102 and the terminal components 201 and 202 can for their part be used to transmit signals between the ship and the terminal of a port facility.

Inasmuch as the rollers 221, 222 and 223 guide the body 10 during the connection of the male element 1 and the female element 2, the rollers 221, 222 and 223 are mounted, in the receptacle 20, between the guide chamber 205 and the terminal components 201, 202 and 203, in the longitudinal direction $X_2$-$X'_2$. Thus, the rollers 221, 222 and 223 give the body 10 an angular orientation with a view to interconnecting the terminal member 103 and the terminal component 203.

As shown in FIGS. 6 and 7, the cylindrical case 206 can interlock with the corresponding central part of the body 10. The body 10 and the case 206 each have a distal opening to enable, during their mutual interlocking, respective electrical contact between the terminal members 101, 102 and 103 and the terminal components 201, 202 and 203.

In order to prevent seawater and/or gas that might form an explosive atmosphere from getting into the housing in which the terminal members 101, 102 and 103 are located, the male member 1 comprises a washer 108 which is mounted around a distal flange of the column 107, so as to close off the distal opening in the body 10.

Figure 5:
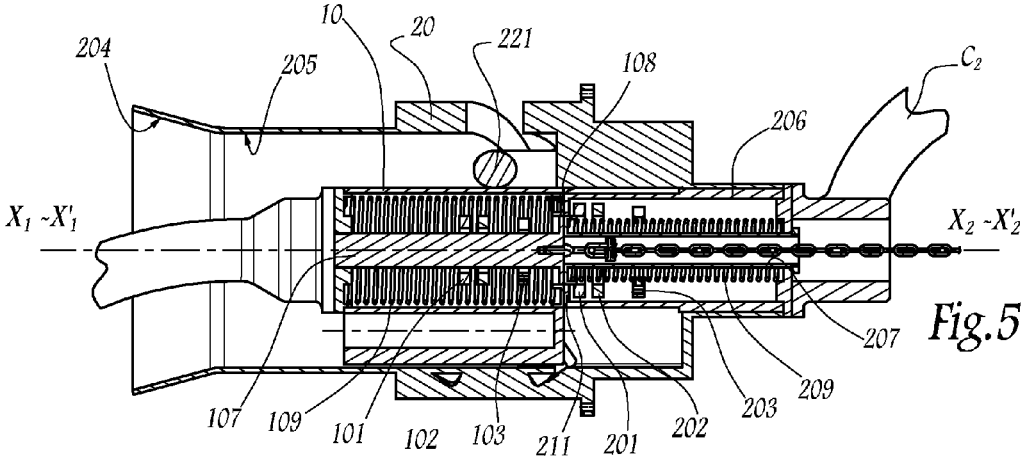

During connection, as illustrated in FIGS. 5 and 6, the washer 108 is able to move inside the body 10 against a helical spring 109 working in compression. The spring 109 is mounted coaxially with the axis $X_1$-$X'_1$, around the column 107 and within a cylindrical wall of the body 10. The spring 109 constitutes a means for returning the washer 108 to a closed-off position, as illustrated in FIG. 4. In this position, the distal face 120 of the body 10 is planar and smooth, thereby avoiding the collection of liquid likely to get in at the electrical contacts during connection. The term "smooth" is intended to mean a surface with no reliefs or irregularities, and thus with no area where liquid can collect.

The distal flange of the column 107 occupies the central region of the distal opening in the body 10, thus defining a generally annular opening having a circular section.

Similarly, the female element 2 comprises an assembly for closing off the distal opening in the case 206 so as to keep seawater and/or gas forming an explosive atmosphere out of the housing for the terminal components 201, 202 and 203.

This closing-off assembly is formed by a distal flange of the tube 207 which coincides with an annular collar 211 forming the distal part of the case 206. The tube 207 is mounted such that it can move inside the case 206, along the axis $X_2$-$X'_2$ and counter to a helical spring 209 working in compression. The spring 209 is mounted coaxially with the axis $X_2$-$X'_2$ and around the tube 207, so as to return the tube 207, and thus its distal flange, into a closed-off position, as illustrated in FIG. 4.

During the connection of the male element 1 in the female element 2, the distal flange 111 of the column 107 comes into contact with the distal flange of the tube 207 (FIG. 5), then pushes the tube 207 against the spring 209 until the terminal members 101, 102 and 103 come into contact with the terminal components 201, 202 and 203 (FIG. 6). Conversely, the distal collar 211 of the case 206 pushes the washer 108 inside the body 110 and against the spring 109. During disconnection, the movable parts move in the opposite direction until the respective distal openings of the body 10 and of the case 206 are sealed off.

A connector in accordance with the invention, which includes a male element and a female element in accordance with the invention, thus enables simple and effective guidance of the male element in the female element with a view to interconnecting electrical power cables. The connector elements have a relatively simple and inexpensive construction. In addition, the rotation of the male element is limited to an angle of at most 60° before this male element takes up an angular orientation that is suitable for connection. Such partial rotation limits the twisting of the electrical power cables to be linked, thereby increasing their service life and also that of the parts which link them to the male and female elements.

The invention has been described here with a male element body having rectilinear distal edges 124, 125 and 126. Alternatively, these distal edges may be convex when they result from the intersection of the longitudinal faces with a convex or domed distal face. Advantageously, this distal face has a smooth surface, i.e. with no irregularities or reliefs which are likely to form an area where liquid can collect. Moreover, the present invention can also be applied to the interconnection of electrical cables having four phases. In this case, the body of the male element is in the form of a prism having a square base.

Alternatively, the male element of the connector can be linked to a ship, while the female element is linked to a port terminal.

The invention claimed is:

1. A female connector element intended to engage with a complementary male connector element for the interconnection of electrical power cables, in particular between a ship and a terminal, the female element having at least one electrically conductive terminal component and a receptacle intended to receive a body of said male element and extending in a longitudinal direction, the female element having a proximal part designed to receive an electrical power cable in order to electrically power the or each terminal component, the receptacle including a chamber for guiding said body translationally in said longitudinal direction, and also at least one guide edge designed to guide said body in rotation about a longitudinal axis of said body, the or each guide edge being located, in said longitudinal direction, between said guide chamber and the or each terminal component, the female element being characterized in that said guide chamber is in the form of a cylinder having a circular base, said circular base being defined by a circle approximately circumscribed about a triangular base of said body of the male element, which is approximately in the form of a prism having an equilateral triangular base, and in that the or each guide edge extends in a plane parallel to the axis of said cylinder, intersecting said cylinder and spaced apart from the axis of said cylinder by a distance corresponding approximately to the apothem of said triangular base, the or each guide edge extending, furthermore, in a direction inclined with respect to the axis of said cylinder at an angle of between 30° and 80°, preferably between 50° and 70°.

2. The female connector element as claimed in claim 1, characterized in that it furthermore comprises at least one cylindrical roller, the or each roller being mounted such that it can rotate with respect to said receptacle, the inner generatrix of the or each roller being able to form the or each guide edge.

3. The female connector element as claimed in claim 2, characterized in that it comprises three rollers defining three guide edges extending in three different planes parallel to the axis of said cylinder, the three planes forming, in section through a plane perpendicular to the axis of said cylinder, a triangle corresponding approximately to said triangular base.

4. The female connector element as claimed in claim 1, characterized in that it furthermore comprises a case forming a housing for the or each terminal component.

5. The female connector element as claimed in claim 4, characterized in that it furthermore comprises a tube extending inside the case, said tube being suitable for holding a traction means such as a chain or a cable, and in that at least one terminal component has surfaces in the form of annular sectors for electrical contact with the or each terminal member.

6. The female connector element as claimed in claim 5, characterized in that the case has a distal opening, in that the distal end of the tube is equipped with a flange for closing off said distal opening, said tube being able to move translationally along the axis of said cylinder, and in that the female element has a member for returning said tube to the closed-off position.

7. A connector for the interconnection of electrical power cables, in particular between a ship and a terminal, including a male element and a female element, characterized in that said female element is as claimed in claim 1, in that said male element has at least one electrically conductive terminal member and a body forming a housing for the or each terminal member, in that the male element has a proximal part designed to take an electrical power cable in order to electrically power the or each terminal member, in that said body is approximately in the form of a prism having an equilateral triangular base, and in that the or each terminal member and the or each terminal component have respectively complementary forms.

8. The connector as claimed in claim 7, characterized in that the body of the male element has a distal face which is generally perpendicular to the axis of said prism, said face defining at least one rectilinear or convex distal edge with a face of said prism.

9. The connector as claimed in claim 7, characterized in that the male element furthermore comprises a column extending inside the body and along the axis of the prism, in that the or each terminal member is mounted on said column, and in that at least one terminal member has at least one surface in the form of an annular sector for electrical contact with the or each terminal component of said female element.

10. The connector as claimed in claim 7, characterized in that the body has a distal opening, in that the male element has means for closing off said distal opening, said closing-off means being able to move inside the body, and in that the male element has means for returning said closing-off means to the closed-off position.

11. The connector as claimed in claim 9, characterized in that the distal end of the column is located in the central region of said distal opening and defines a generally annular opening, in that the closing-off means comprise a washer having the form of said annular distal opening, said washer being able to slide along the axis of the prism, and in that said return means include a helical spring working in compression in the direction of the axis.

12. The connector as claimed in claim 7, characterized in that the distal face of the body has a smooth surface having a planar or convex form.

13. The connector as claimed in claim 9, characterized in that said column comprises a fastening member for attaching a traction means such as a chain or a cable.

* * * * *